US010793342B2

(12) United States Patent
Minson et al.

(10) Patent No.: US 10,793,342 B2
(45) Date of Patent: Oct. 6, 2020

(54) CREDIT CARD DISPENSER

(71) Applicant: John Minson, Salt Lake City, UT (US)

(72) Inventors: John Minson, Salt Lake City, UT (US); Dan Loveridge, Salt Lake City, UT (US); Amol Deshmukh, Salt Lake City, UT (US)

(73) Assignee: John Minson, Salt Lake City, UT (US)

( * ) Notice: Subject to any disclaimer, the term of this patent is extended or adjusted under 35 U.S.C. 154(b) by 344 days.

(21) Appl. No.: 13/943,397

(22) Filed: Jul. 16, 2013

(65) Prior Publication Data

US 2014/0014676 A1 Jan. 16, 2014

Related U.S. Application Data

(60) Provisional application No. 61/672,193, filed on Jul. 16, 2012.

(51) Int. Cl.
*B65D 83/08* (2006.01)
*A45C 11/18* (2006.01)

(52) U.S. Cl.
CPC ..... *B65D 83/0829* (2013.01); *A45C 11/182* (2013.01); *A45C 2011/186* (2013.01)

(58) Field of Classification Search
CPC ..... B65D 83/0805; B65D 83/0811; B65D 83/0823; B65D 83/0829; B65D 83/0847; B65D 83/0894; G07F 11/22
USPC ..... 221/208, 226, 254, 268, 272, 274, 276
See application file for complete search history.

(56) References Cited

U.S. PATENT DOCUMENTS 622,807 A * 4/1899 Joy ..... 221/232
830,772 A * 9/1906 Dunn ..... B65D 83/0409 221/267
1,024,392 A * 4/1912 Branyan ..... 221/269
1,036,198 A * 8/1912 Dunn ..... B65D 85/1009 221/260

(Continued)

OTHER PUBLICATIONS

Secrid products, http://www.secrid/en/index.html, accessed Oct. 15, 2012, 1 page.

(Continued)

*Primary Examiner* — Gene O Crawford
*Assistant Examiner* — Kelvin L Randall, Jr.
(74) *Attorney, Agent, or Firm* — Thorpe North & Western, LLP

(57) ABSTRACT

A card dispenser can include a planar sleeve, an actuator, and a lifter assembly. More specifically, the planar sleeve can be shaped to receive a plurality of cards within a card chamber. A dispense opening within the planar sleeve can be shaped to pass the plurality of cards edgewise. The actuator can extend along an edge of the planar sleeve. The actuator can be pivotable about an actuator pivot located between a retaining end and an actuation end of the actuator. The actuator pivots from a retaining position to a dispense position. The retaining position orients a card contact surface of the retaining end against the plurality of cards to prevent removal of the plurality of cards. The lifter assembly can be associated with the actuation end and can be oriented adjacent a bottom edge of the card chamber. The lifter assembly can be adapted to apply force to at least one of the plurality of cards, upon movement of the actuator to the dispense position, sufficient to dispense at least one of the plurality of cards from the dispense opening.

28 Claims, 12 Drawing Sheets

(56) References Cited

U.S. PATENT DOCUMENTS 1,075,173 A 10/1913 Vidinghoff
1,465,902 A * 8/1923 Gould ..... 221/271
1,516,819 A * 11/1924 Johnson ..... 221/250
1,763,857 A 6/1930 Ostrander
2,626,197 A 6/1953 Kollock
2,795,354 A 6/1957 Freundlich et al.
3,263,860 A 8/1966 Haas
3,565,284 A 2/1971 Hinterreiter et al.
3,853,379 A * 12/1974 Goodman ..... H01R 12/89 361/801
4,070,081 A * 1/1978 Takahashi ..... 439/372
4,178,051 A * 12/1979 Kocher ..... H01R 13/633 439/157
4,447,101 A * 5/1984 Gugliotti ..... H01R 13/633 439/153
4,629,092 A * 12/1986 English ..... 221/247
4,697,698 A 10/1987 Holdener
4,852,727 A * 8/1989 Oberle ..... 206/39.4
4,887,739 A 12/1989 Parker
5,033,972 A * 7/1991 Komatsu ..... G06K 7/0047 439/153
5,125,505 A * 6/1992 Kurosaki ..... 206/39.4
5,131,565 A 6/1992 Lilly
5,351,858 A * 10/1994 Bar-Yona et al. ..... 221/266
5,383,789 A * 1/1995 Watanabe ..... G06K 13/0806 361/754
5,452,793 A * 9/1995 DiMeo et al. ..... 206/39
5,460,295 A 10/1995 Law
5,466,166 A * 11/1995 Law ..... G06K 7/0047 439/157
5,482,183 A 1/1996 Beal et al.
5,577,922 A * 11/1996 Enomoto ..... H01R 13/635 439/157
5,655,918 A * 8/1997 Soh ..... H01R 13/635 439/159
5,718,329 A 2/1998 Ippolito et al.
5,730,319 A 3/1998 Gray et al.
5,894,931 A * 4/1999 Dunn ..... 206/555
5,894,954 A 4/1999 Horden
5,960,944 A * 10/1999 Plocher ..... A45C 11/182 206/39.4
6,050,449 A 4/2000 Kanj
6,095,835 A * 8/2000 Oguchi ..... G06K 13/08 439/159
6,146,165 A * 11/2000 Reich ..... H05K 7/1409 439/159
6,155,410 A 12/2000 Davis
6,210,188 B1 * 4/2001 Chang ..... 439/159
6,230,879 B1 * 5/2001 Lin ..... B65D 83/0829 206/39.4
6,267,609 B1 * 7/2001 Korsunsky ..... G06K 13/0806 439/159
D447,337 S * 9/2001 Sardina ..... D3/247
6,315,583 B1 * 11/2001 Nishioka ..... 439/131
6,347,142 B1 * 2/2002 Bernardet ..... G06K 7/0021 379/433.09
6,361,339 B1 * 3/2002 Zhang ..... H01R 13/6335 439/160
6,412,627 B1 7/2002 Tiscaine et al.
6,581,762 B2 6/2003 Keough
6,978,903 B2 * 12/2005 Son ..... G06F 1/184 211/26
7,267,147 B2 * 9/2007 Tiscione ..... 150/147
7,326,070 B2 * 2/2008 Chen ..... G06K 13/08 439/159
7,386,868 B2 * 6/2008 McCormack ..... G06F 1/1632 361/679.41
7,617,928 B1 11/2009 Murphy
7,857,022 B2 12/2010 Kraml
8,662,293 B2 * 3/2014 Lazott et al. ..... 206/39.4
8,899,411 B2 * 12/2014 Van Geer ..... 206/39.4
8,944,833 B2 * 2/2015 Takahashi et al. ..... 439/159
9,837,765 B2 * 12/2017 Heiskanen ..... H01R 13/6335
2005/0011776 A1 1/2005 Nagel
2009/0101255 A1 * 4/2009 Long ..... A45C 11/182 150/147
2010/0038000 A1 2/2010 Ho
2010/0065171 A1 3/2010 Uzelac
2011/0108565 A1 * 5/2011 Patton et al. ..... 221/37
2012/0067747 A1 * 3/2012 Van Geer ..... A45C 11/182 206/39
2015/0335118 A1 * 11/2015 Van Geer ..... A45C 11/182 150/147
2018/0310681 A1 * 11/2018 Wingerter ..... A45C 11/182
2018/0338593 A1 * 11/2018 Scharnigg ..... A45C 11/182

OTHER PUBLICATIONS

Van Geer, Secrid promotional video, http://www.youtube.com/watch?v=GbH9AylytFY, originally accessed Oct. 15, 2012, 2 pages.

* cited by examiner

CREDIT CARD DISPENSER

RELATED APPLICATION

This application claims the benefit of U.S. Provisional Application No. 61/672,193, filed Jul. 16, 2012, which is incorporated herein by reference.

BACKGROUND

Despite the growth of electronic communication and commerce, individuals continue to carry a large variety of cards which allow for business transaction, purchases, identification, membership confirmation, medical treatment, and a host of other important activities. Organization and transport of such cards is typically accomplished using a wallet or purse with various sleeves and pockets in which such cards are placed. These options often provide limited durability, relatively large profiles, slow retrieval times and lack security against RFID (radio frequency identification) theft. As such, additional options and improvements continue to be sought to tailor card transport solutions to various individual preferences and practical benefits.

SUMMARY

A card dispenser can include a planar sleeve, an actuator, and a lifter assembly. More specifically, the planar sleeve can be shaped to receive a plurality of cards within a card chamber. A dispense opening within the planar sleeve can be shaped to pass the plurality of cards edgewise. The actuator can extend along an edge of the planar sleeve. The actuator can be pivotable about an actuator pivot located between a retaining end and an actuation end of the actuator. In this manner, the actuator pivots from a retaining position to a dispense position. The retaining position orients a card contact surface of the retaining end against the plurality of cards to prevent removal of the plurality of cards. The lifter assembly can be associated with the actuation end and can be oriented adjacent a bottom edge of the card chamber. The lifter assembly can be adapted to apply force to at least one of the plurality of cards, upon movement of the actuator to the dispense position, sufficient to dispense at least one of the plurality of cards from the dispense opening.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
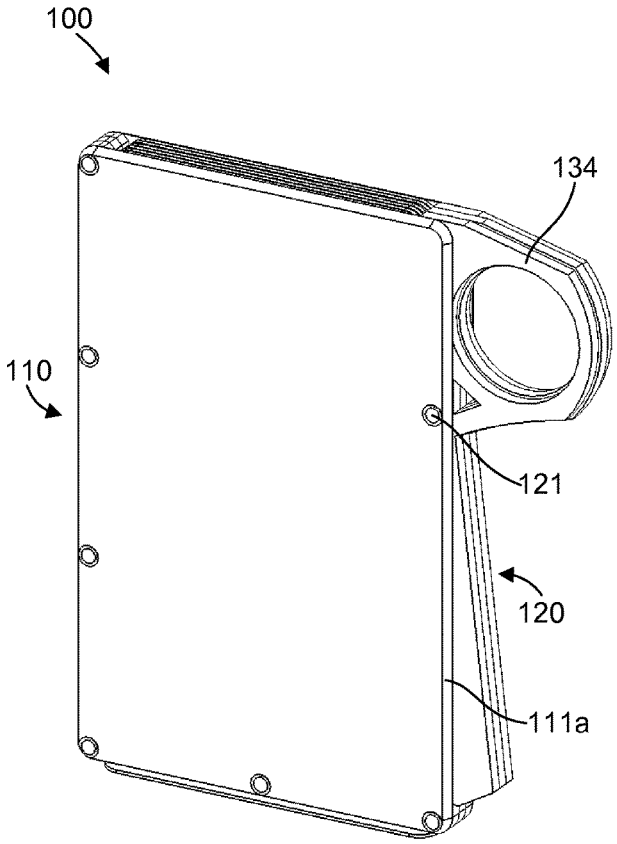
FIG. 1A is a front perspective view of a card dispenser and cards with an actuator in a retaining position in accordance with one embodiment of the present invention.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a spring" includes reference to one or more of such features and reference to "actuating" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Card Dispenser

Figure 1B:
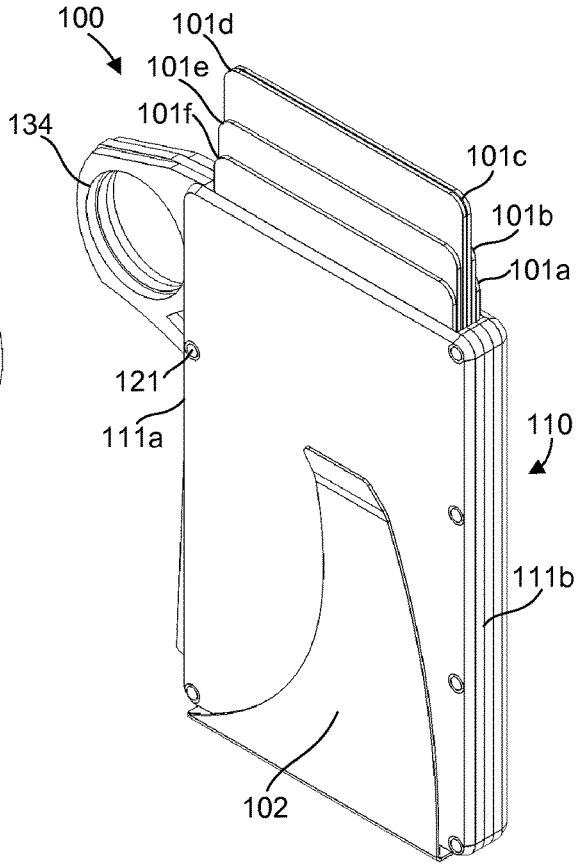
FIG. 1B is a back perspective view of the card dispenser and cards of FIG. 1A with the actuator in a dispense position.

Referring generally to FIGS. 1A and 1B, a card dispenser 100 is illustrated in accordance with one embodiment of the present disclosure. The card dispenser can include a planar sleeve 110, which can be shaped to receive a plurality of cards 101*a-f*. The card dispenser can be configured and used for a wide variety of cards. Non-limiting examples of cards that can be held and dispensed include credit card, debit card, bank card, driver's license card, discount card, group membership card, medical card, permit identification, and business card. A pivotable actuator 120 can be used to engage and release the cards. Specifically, the actuator can extend along an edge 111*a* of the planar sleeve and the actuator can be pivotable about an actuator pivot 121 to cause the cards to extend from the planar sleeve where the cards can be accessible by a user to retrieve the cards from the card dispenser, as shown in FIG. 1B. The card dispenser can optionally include additional features such as, but not limited to, a money clip 102 attached to the planar sleeve, a releasable latch, a magnetic surface on a side panel of the card dispenser, and the like.

Figure 2A:
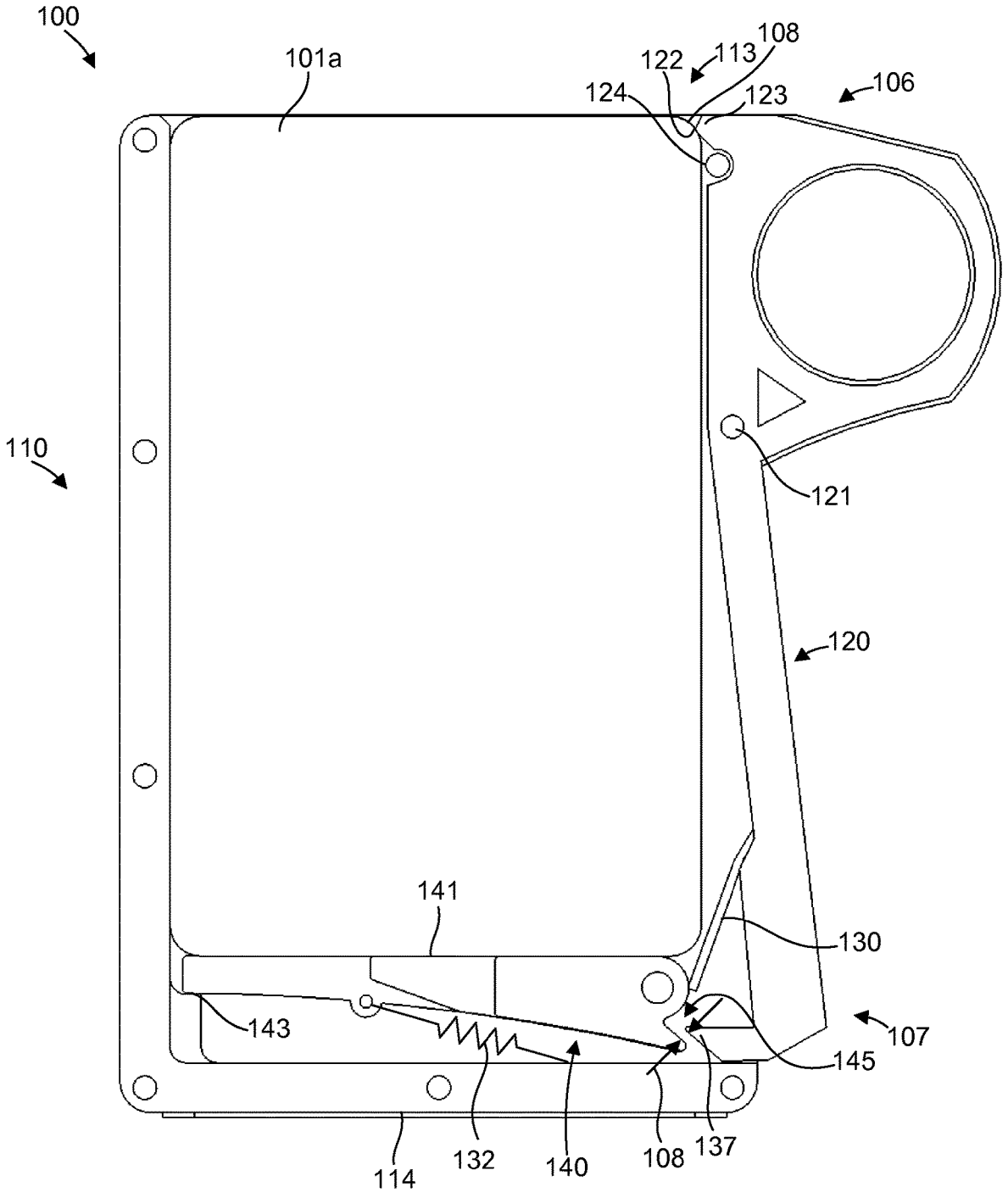
FIG. 2A is a partial cut-away view of the card dispenser and cards of FIG. 1A showing a lifter assembly and actuator in the retaining position.
Figure 2B:
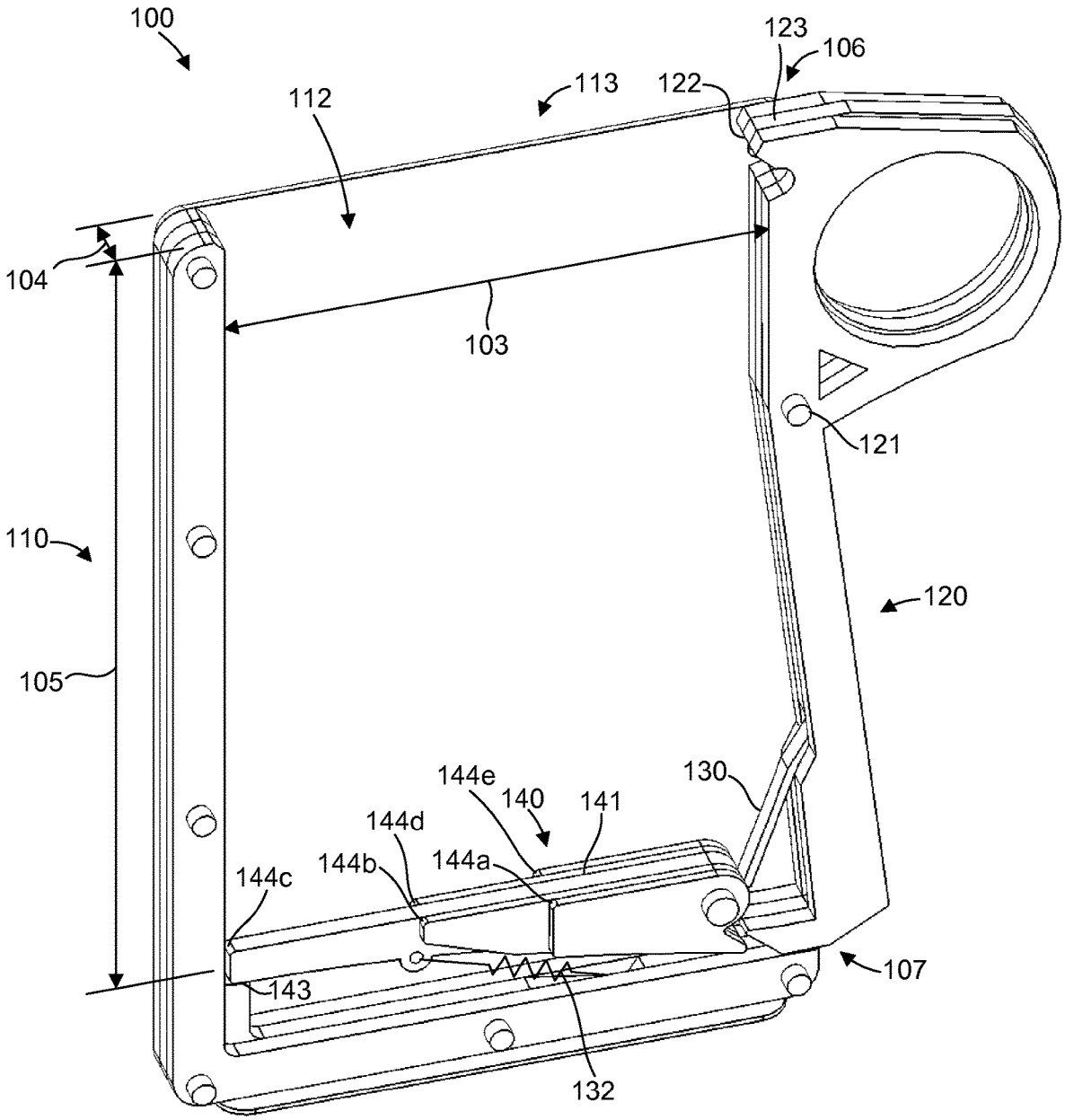
FIG. 2B is a partial cut-away view of the card dispenser of FIG. 1A with the cards omitted and showing the lifter assembly and actuator in the retaining position.
Figure 3:
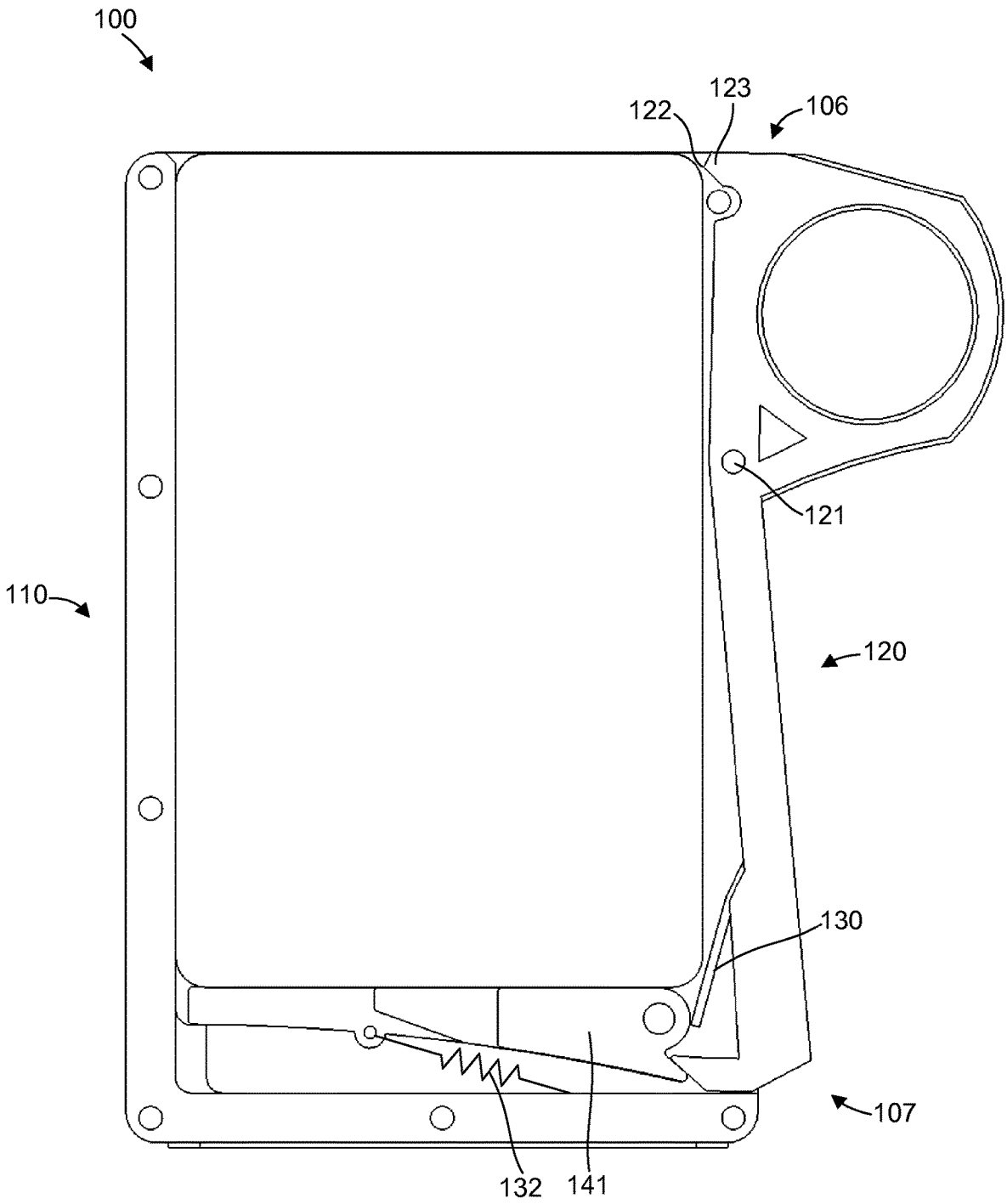
FIG. 3 is a partial cut-away view of the card dispenser and cards of FIG. 1A showing the actuator when initially moved toward the dispense position.
Figure 4A:
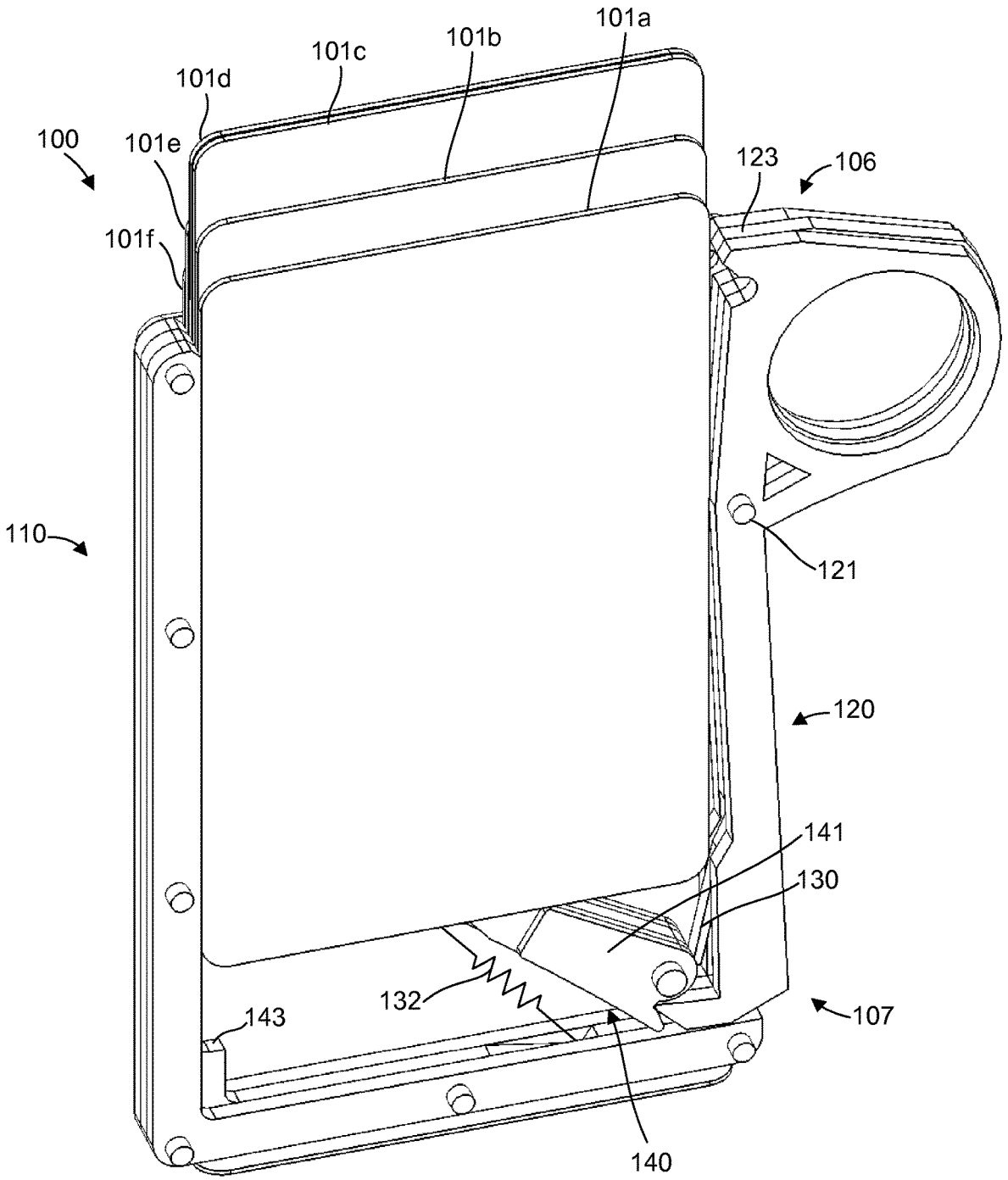
FIG. 4A is a partial cut-away view of the card dispenser and cards of FIG. 1A showing the lifter assembly and actuator in the dispense position.
Figure 4B:
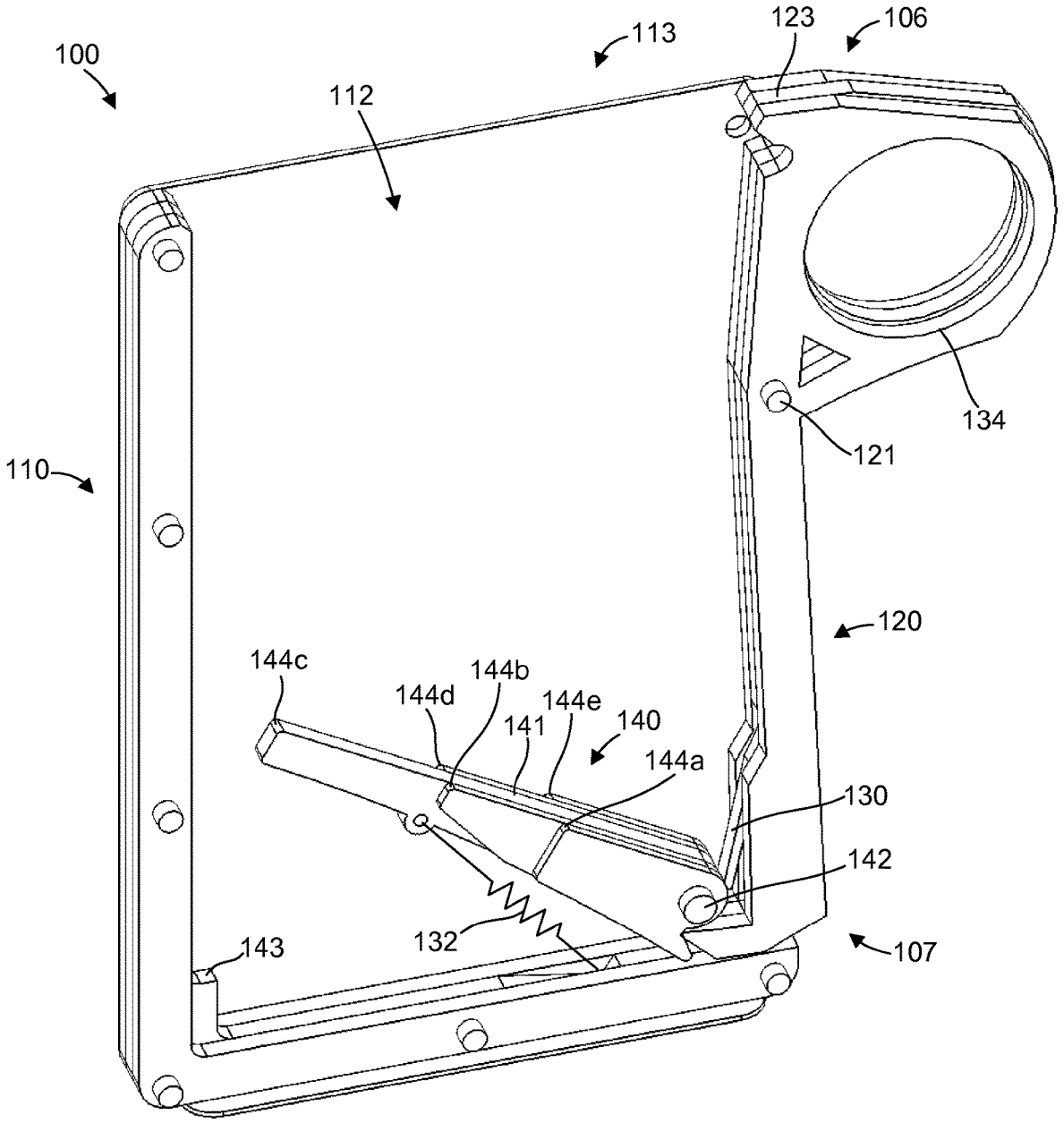
FIG. 4B is a partial cut-away view of the card dispenser of FIG. 1A with the cards omitted and showing the lifter assembly and actuator in the dispense position.

With reference to FIGS. 2A-4B and continued reference to FIGS. 1A and 1B, internal structures and operation of the card dispenser 100 are discussed. For example, FIG. 2A illustrates the card dispenser 100 with a side panel of the planar sleeve omitted to reveal an interior of the card dispenser when the cards are stored within the card dispenser. FIG. 2B is similar to FIG. 2A but omits the cards to reveal additional features of the card dispenser when in a storage configuration for the cards. FIG. 3 illustrates the card dispenser with a side panel of the planar sleeve omitted to reveal an interior of the card dispenser when the actuator is initially moved to dispense the cards. In addition, FIG. 4A illustrates the card dispenser 100 with a side panel of the planar sleeve omitted to reveal an interior of the card dispenser when dispensing cards. FIG. 4B is similar to FIG. 4A but omits the cards to reveal additional features of the card dispenser while dispensing cards.

Although illustrated in several figures, FIGS. 1A and 1B in particular show the planar sleeve 110 can be shaped to receive the plurality of cards 101*a-f* within a card chamber 112 (shown in FIG. 2B). The planar sleeve can often be externally shaped to provide a slim profile for carrying within a pants pocket. In one aspect, the external profile can be generally planar with narrow outer edges 111*a*, 111*b*. The card chamber can be similarly shaped. For example, as shown in FIG. 2B, the card chamber 112 can have a width 103 from 4.5 cm to 6 cm, a depth 104 from 3 mm to 10 mm, and a length 105 from 7.5 cm to 11 cm. Most often, the card chamber has a single dispense opening 113 through which the cards can be removed from the card chamber. A dispense opening within the planar sleeve can be shaped to pass the plurality of cards edgewise. In one aspect, the card chamber can be formed of a metal which isolates cards from RFID signals. Non-limiting examples of such metals can include aluminum, stainless steel, copper, nickel, titanium, alloys thereof, and the like. Other non-metal materials can be layered with such metals in order to provide variations in weight, cost, aesthetic design options, and other factors. Alternatively, the card chamber can also be formed of a non-metal and/or non-conductive base material (e.g. carbon fiber, plastic, composite, etc) with a metal mesh or perforated metal sheet layer which maintains RFID shielding.

The pivotable actuator 120 can be used to facilitate engagement and release the cards 101*a-f*. In one aspect, the cards can be retained within the card chamber 112 by a mechanical interference provided by the actuator that blocks or prevents cards from exiting the chamber 112 through the dispense opening 113. Specifically, the pivotable actuator can extend along the edge 111*a* of the planar sleeve 110 and can be pivotable about the actuator pivot 121 located between a retaining end 106 and an actuation end 107 of the actuator. In this manner, the actuator pivots between a retaining position (FIGS. 2A and 2B) and a dispense position (FIGS. 4A and 4B). The retaining position orients a card contact surface 122 of the retaining end against edges 108 at ends of the cards to prevent removal of the cards via a mechanical interference with the cards. The dispense position orients the card contact surface such that no structural interference from the card contact surface prevents removal of the cards from the chamber. In one aspect, the pivotable actuator can include a protrusion 123 that positions the card contact surface to physically interfere with removal of the cards from the chamber 112 via the opening 113. For example, the actuator can include an elongate member having a protrusion with a non-planar inner card contact surface, which faces the card chamber such that the inner card contact surface only contacts the cards in the retaining position. A mechanical stop 124, such as a pin, can be configured to limit movement of the actuator, such as movement of the protrusion into the chamber, and can establish the retaining position of the actuator. The card contact surface can comprise any suitable material, such as a rubber, plastic, and/or a metal material.

The card dispenser 100 can further include a lifter assembly 140 to facilitate removal of the cards 101*a-f* from the chamber 112. As shown in FIGS. 4A and 4B, the actuator 120 physically engages with the lifter assembly to force one or more cards out of the card chamber. The lifter assembly can be associated with the actuation end 107 of the actuator and can be located at or near an interior end of the card chamber opposite the dispense opening 113, such as at a bottom edge of the chamber or planar sleeve. The lifter assembly can be adapted to apply force to at least one of the cards, upon movement of the actuator, to the dispense position sufficient to dispense at least one of the plurality of cards from the dispense opening.

Generally, the lifter assembly 140 includes an elongate lifter arm 141 which rotates about a lifter pivot 142 from a rest position (FIGS. 2A and 2B) to a lift position (FIGS. 4A and 4B). Typically, the rest position and the lift position correspond to the retaining position and the dispense position of the actuator, respectively. The lifter arm can extend substantially along the interior end of the card chamber and can be oriented substantially parallel to the bottom edge 114 of the planar sleeve 110 when in the rest position. For example, the pivot 142 and a rest 143 can support the lifter arm when in the rest position. The lifter pivot can be proximate the actuation end 107 of the actuator 120 and fixed relative to the card chamber 112. Shown particularly in FIG. 2A, the lifter arm can include an engagement notch 145 to facilitate engagement with the actuation end of the actuator, such as an extension 137, to rotate the lifter arm about the lifter pivot. In one aspect, the actuator and lifter arm can be configured to be in sliding-rotating contact with one another, such as via the engagement notch and the actuation end of the actuator, as the actuator acts on the lifter arm to cause rotation of the lifter arm about the lifter pivot.

With particular reference to FIGS. 2A and 3, the card dispenser 100 can be configured to facilitate at least a partial release of the cards 101*a-f* by the actuator 120 prior to actuation of lifter arm 140 or movement of the actuator to the dispense position. For example, the actuator 120 can be pivoted about the actuator pivot 121 to bring the card contact surface 122 of the protrusion 123 out of contact with the cards before the actuator acts on the lifter arm to cause motion of the lifter arm about the lifter pivot 142. This can be made possible by a gap 108 that exists between the actuator and the lifter arm when the actuator is in the retaining position, as shown in FIG. 2A. Thus, the card dispenser can be configured for two-stage operation in order to dispense a card. For example, the actuator can first be moved from the retaining position through the gap to release the actuator from the cards and at least partially vacate the opening to remove the mechanical interference from the opening. The actuator can therefore move, at least initially, independent of the lifter arm to release the cards from contact and/or mechanical interference. The actuator can then be further pivoted to cause the lifter arm to force the cards through the opening, which was previously vacated by the actuator protrusion.

With particular reference to FIGS. 2B and 4B, the lifter arm 141 can include at least one staged taper 144*a-e* longitudinally oriented along the lifter arm and spaced so as to dispense the cards at multiple distances from the card chamber, as shown in FIGS. 1B and 4A. The spacing and width of staged tapers results in distribution of cards as the lifter arm is moved to the dispense position. In one aspect, the staged tapers can be located on a single side or on two opposite sides (shown) of the lifter arm. Each stage can support one or several cards. For example, stage 144*a* is configured to support a single card 101*a* and stage 144*c* is configured to support two cards 101*c* and 101*d*. FIG. 4A shows the lifter arm in the dispense position and the cards distributed at three heights.

Although the actuator 120 can be free moving, the actuator can be biased to ensure positioning of the actuator in the retaining position. As such, a biasing component 130 can be operative to move the actuator into the retaining position. In one alternative, the biasing member comprises a cantilever spring, as shown in FIGS. 2A-4B. In this case, the cantilever spring can be configured to act against the actuator and the lifter assembly 140, although it should be recognized that any suitable configuration may be employed. Similarly, the lifter arm 141 can be biased to the rest position to prevent the lifter assembly from tending to force the cards 101*a-f* from the chamber 112 unless acted upon by the actuator. In one aspect, a biasing component 132, such as a spring, can be coupled between the lifter arm 141 and an inner portion of the planar sleeve to bias the lifter arm toward the rest position of the lifter arm. In another aspect, the biasing component can comprise a torsional spring that can be disposed about the lifter pivot 142 and configured to act on the lifter arm and the planar sleeve 110 to bias the lifter arm to the rest position. In addition, a finger loop 134 can be optionally oriented proximate the retaining end opposite the card contact surface. This can provide additional security for handling the dispenser. In one aspect, one or more components of the card dispenser 100 can be fabricated with a multiply construction, although it should be recognized that any suitable type of construction may be utilized.

Figure 5A:
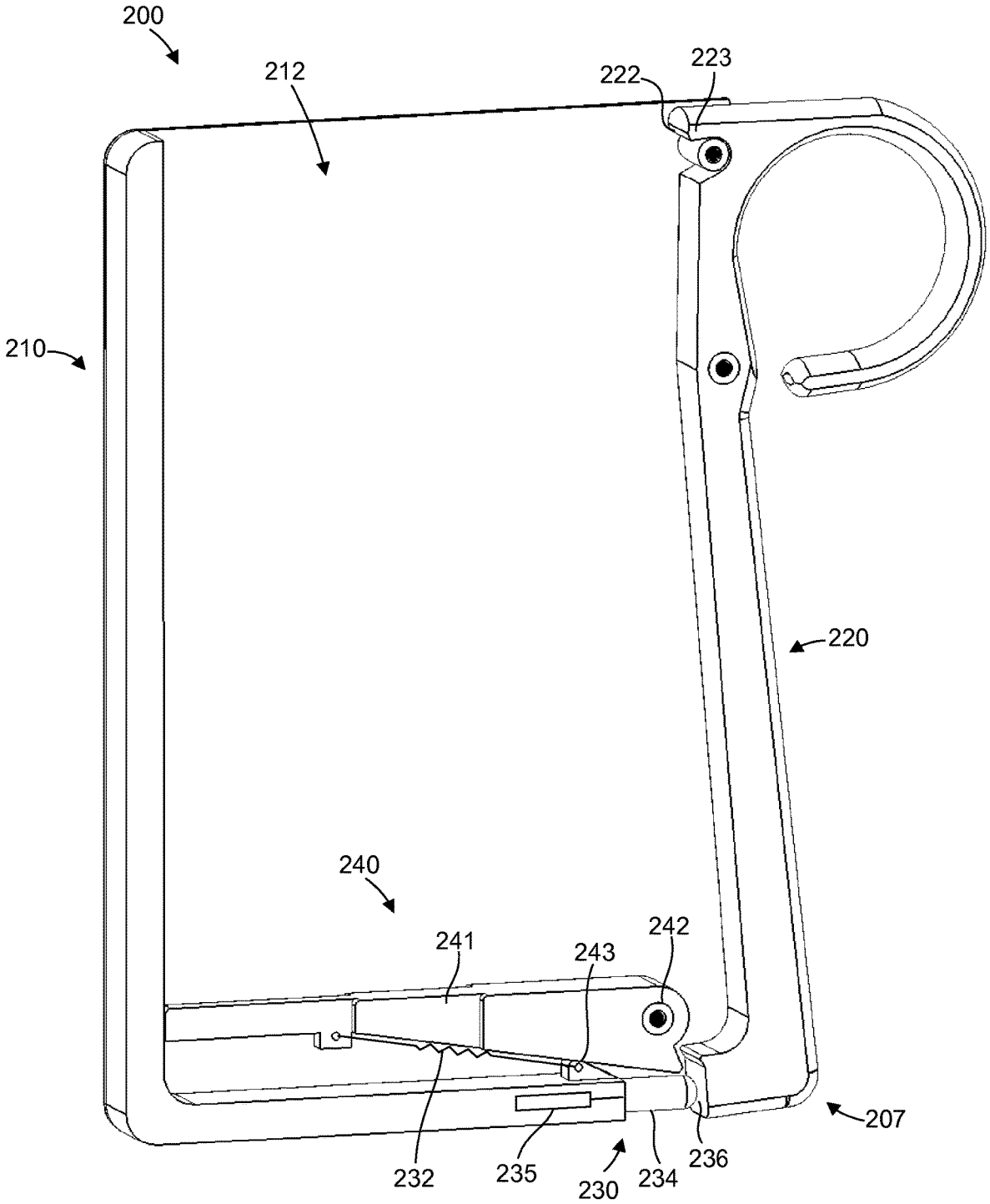
FIG. 5A is a partial cut-away view of a card dispenser with an actuator in a retaining position in accordance with another embodiment of the present invention.
Figure 5B:
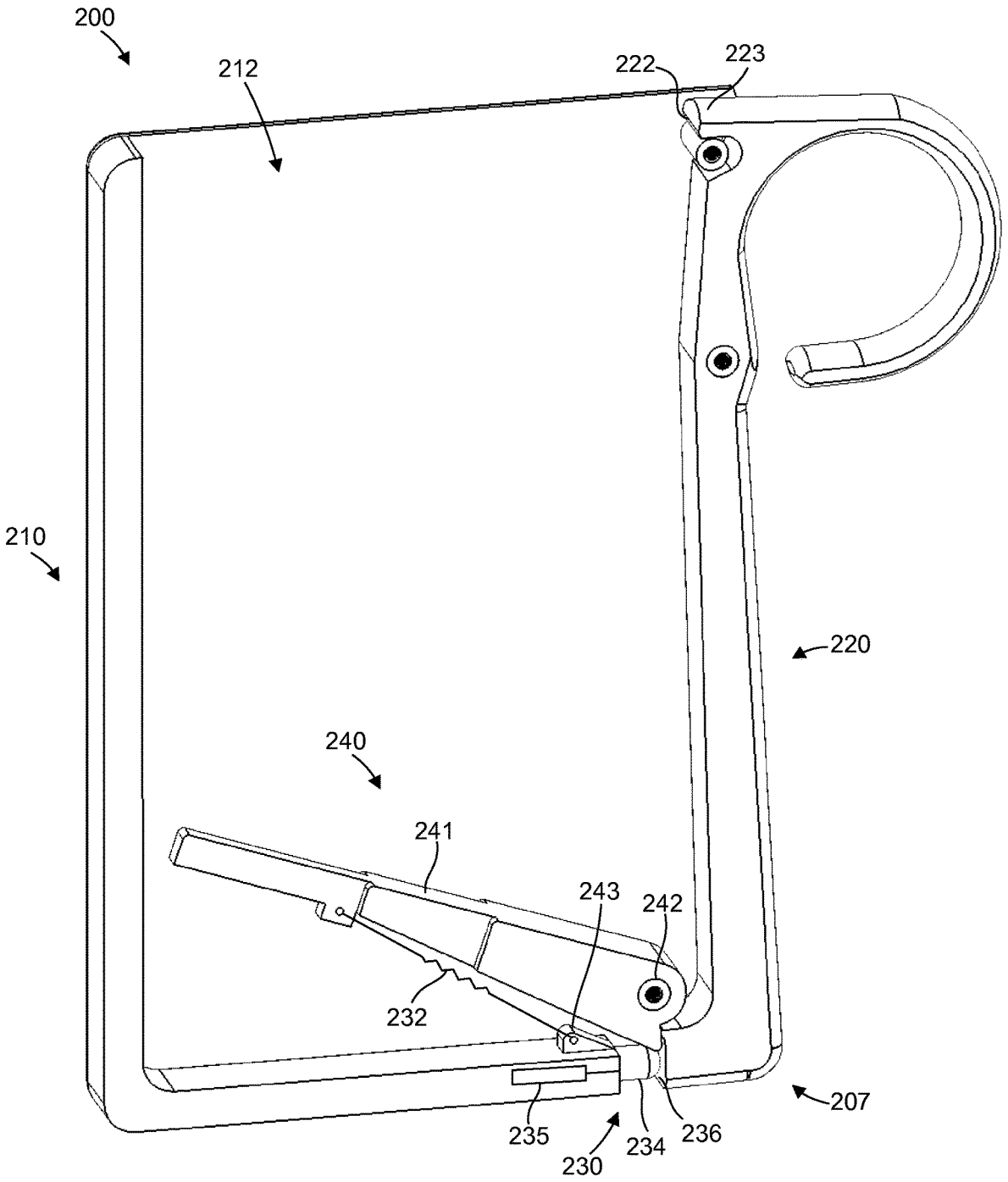
FIG. 5B is a partial cut-away view of the card dispenser of FIG. 5A with the cards omitted and showing the lifter assembly and actuator in the dispense position.

FIGS. 5A and 5B illustrate a card dispenser 200 in accordance with another embodiment of the present disclosure. The card dispenser 200 is similar to the card dispenser 100 of FIGS. 1A-4B in many respects, such as having a planar sleeve 210 (an outer panel of which is omitted to reveal an interior of the card dispenser), an actuator 220, and a lifter assembly 240 with a lifter arm 241. In addition, the actuator has a protrusion 223 with a card contact surface 222 to retain cards within a chamber 212 by a mechanical interference. The actuator can also be configured to move independent of the lifter arm, at least initially, to release cards from contact and/or mechanical interference with the actuator prior to moving the lifter arm to dispense the cards or moving to a dispense position (FIG. 5B). The lifter arm can be maintained in a rest position by a lifter pivot 242 and a rest 243. In this case a biasing component 232 can be coupled to the lifter arm and the rest in order to bias the lifter arm toward the rest position. Additionally, the card dispenser can include a biasing component 230 to move the actuator toward a retaining position (FIG. 5A). The biasing component 230 can comprise a pin 234 or plunger which is in contact with an actuation end 207 of the actuator, such as a land 236 configured to interface with the pin. In one aspect, the pin can be spring loaded by a spring 235 associated with the planar sleeve to apply a force to the actuator tending to move the actuator toward the retaining position.

Figure 6A:
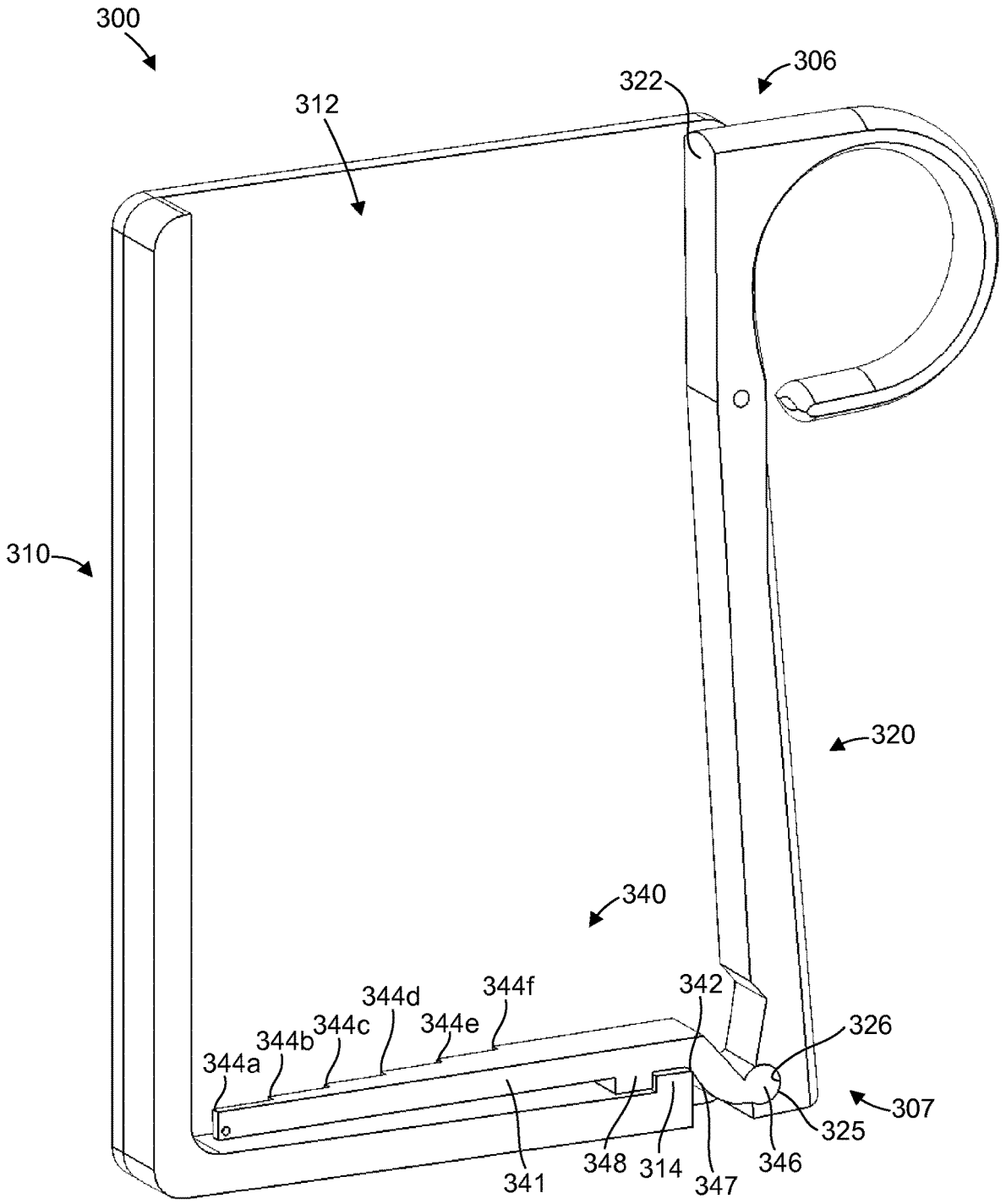
FIG. 6A is a partial cut-away view of a card dispenser with an actuator in a retaining position in accordance with yet another embodiment of the present invention.
Figure 6B:
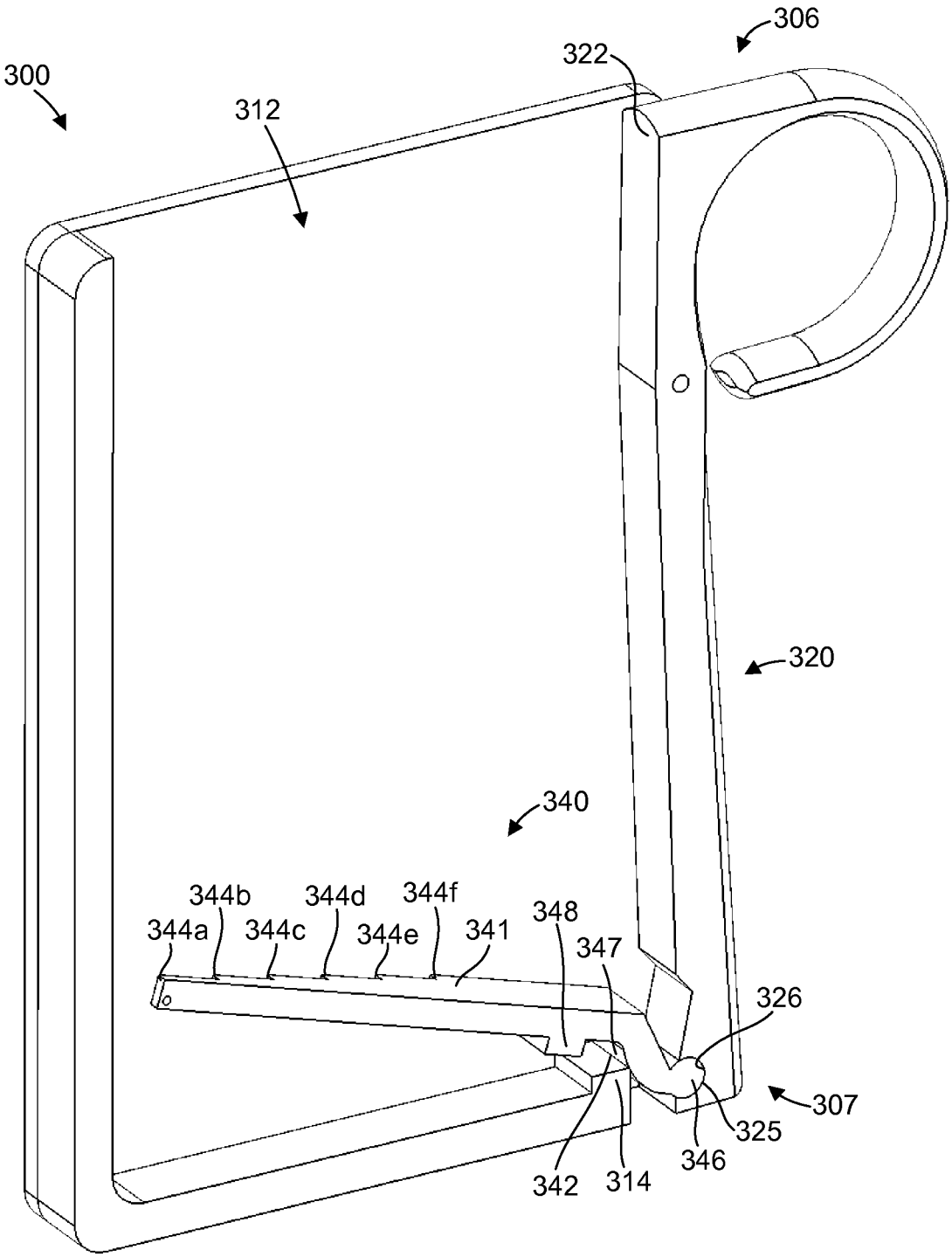
FIG. 6B is a partial cut-away view of the card dispenser of FIG. 6A with the cards omitted and showing the lifter assembly and actuator in the dispense position.

FIGS. 6A and 6B illustrate a card dispenser 300 in accordance with yet another embodiment of the present disclosure. The card dispenser 300 is similar to other card dispensers disclosed herein in many respects, such as having a planar sleeve 310 (an outer panel of which is omitted to reveal an interior of the card dispenser), an actuator 320, and a lifter assembly 340 with a lifter arm 341. In this case, however, the actuator includes a card contact surface 322 configured to retain cards within a chamber 312 by friction, rather than a mechanical interference as in previously discussed embodiments. In other words, cards can be retained within the card chamber by applying a bias pressure against edges of the cards. The retaining position orients the card contact surface of a retaining end 306 against the edges of the cards to prevent removal of the cards via friction resistance, such as a frictional interface with the cards. A biasing member can be used in a similar fashion as described previously with respect to FIG. 2A.

In addition, the lifter arm 341 can be pivotally associated with the actuation end 307 of the actuator 320 to form a lifter pivot 325. For example, the actuator and the lifter arm can be configured to move with one another via the pivot coupling 325 in which an end 346 of the lifter arm is configured to rotatably interface with a socket 326 of the actuator. In this embodiment, the actuator is not movable independent of the lifter arm to provide an initial release of the cards from contact. This is possible because there is no mechanical interference with the actuator to prevent dispensing of the cards. Once the card contact surface 322 has been withdrawn or removed from the cards eliminating the frictional resistance, the cards can be immediately dispensed by the lifter arm.

The planar sleeve can also include a shoulder 314 that can serve as a lifter pivot fulcrum 342 for the lifter arm 341 to pivot about as a surface 347 the lifter arm is caused to slide across the shoulder by the actuator to dispense the cards. In other words, the bottom edge of the card chamber can include a fixed surface against which the lifter arm slides to cause pivoting about the lifter pivot. The lifter arm can therefore be in sliding-rotating contact with the fulcrum provided by the shoulder to cause rotation of the lifter arm. The shoulder can also contact the lifter arm, such as by interlocking between the surface 347 and a tab 348 of the lifter arm, to establish the rest position of the lifter arm. Additionally, the lifter arm 341 can include staged tapers 344*a-e* longitudinally oriented along a single side of the lifter arm and spaced so as to dispense the cards at multiple distances from the card chamber.

Figure 7A:
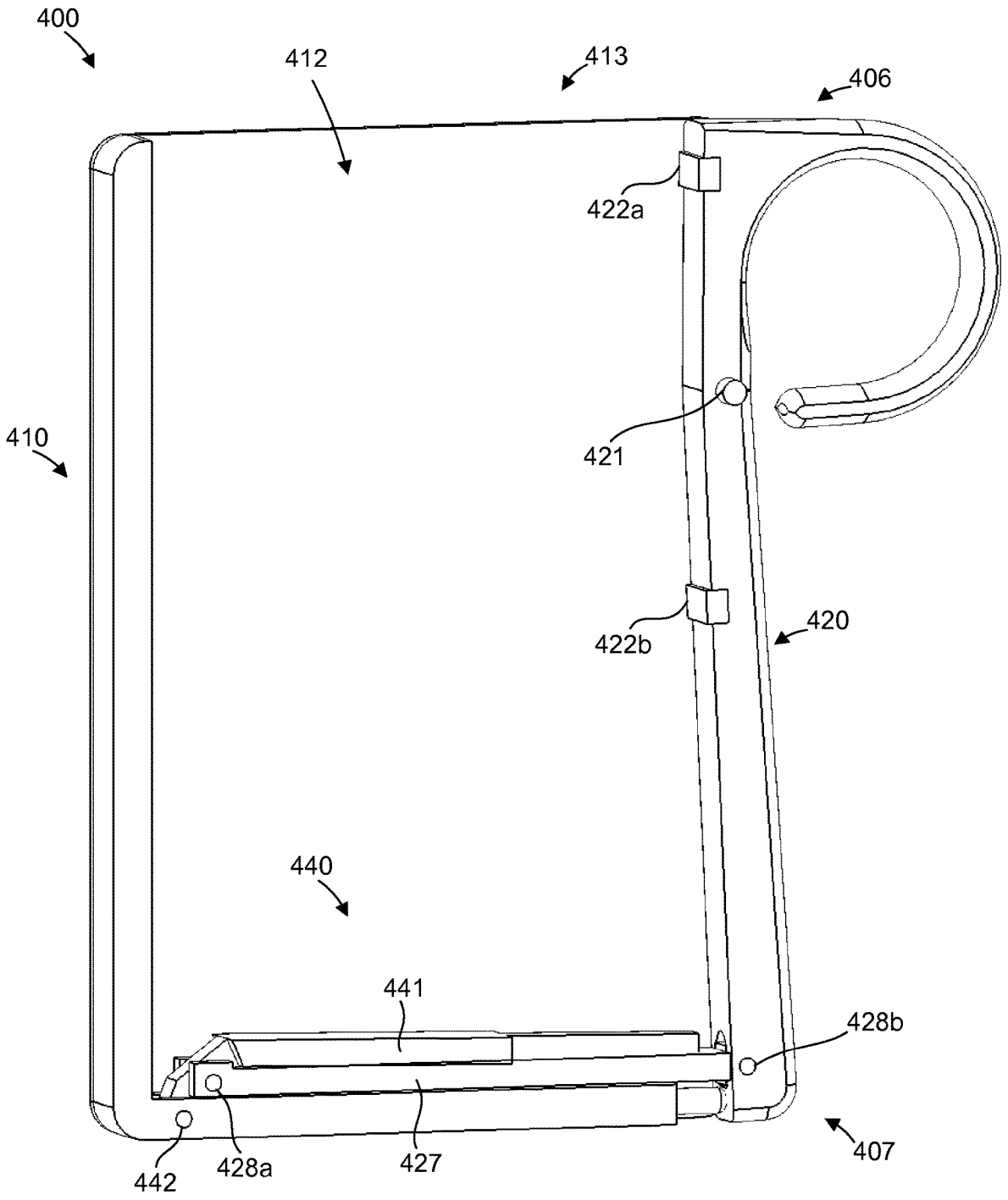
FIG. 7A is a partial cut-away view of a card dispenser with an actuator in a retaining position in accordance with still another embodiment of the present invention.
Figure 7B:
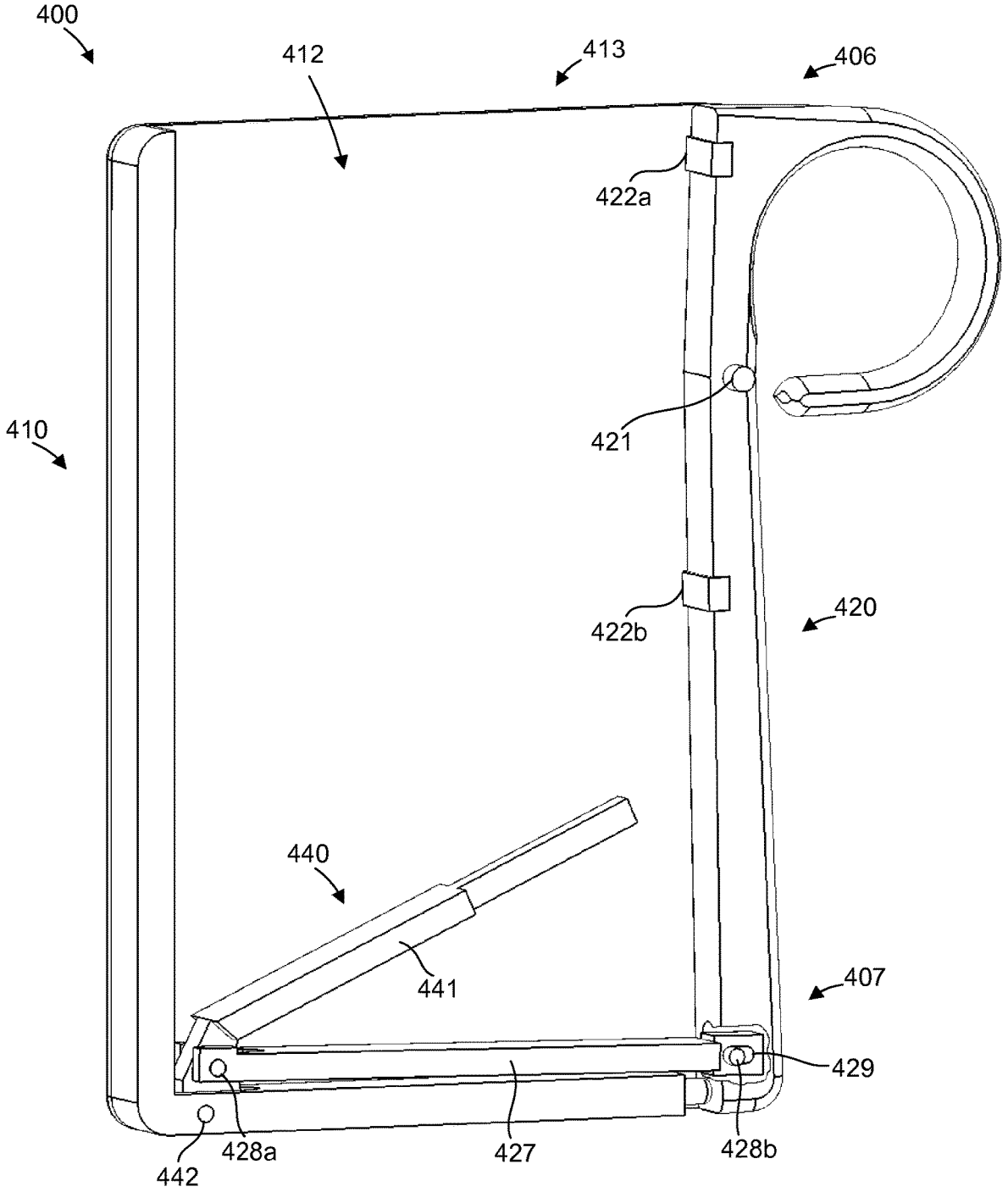
FIG. 7B is a partial cut-away view of the card dispenser of FIG. 7A with the cards omitted and showing the lifter assembly and actuator in the dispense position.

FIGS. 7A and 7B illustrate a card dispenser 400 in accordance with still another embodiment of the present disclosure. The card dispenser 400 is similar to the card dispenser 300 of FIGS. 6A and 6B in many respects, such as having a planar sleeve 410 (an outer panel of which is omitted to reveal an interior of the card dispenser), an actuator 420, and a lifter assembly 440 with a lifter arm 441. In addition, the actuator includes a card contact surface 422*a* configured to retain cards within a chamber 412 by friction, rather than a mechanical interference as in some other embodiments. Thus, the cards can be retained within the card chamber by applying a bias pressure against edges of the cards. The retaining position orients the card contact surface of a retaining end 406 against the edges of the cards to prevent removal of the cards via friction resistance, such as a frictional interface with the cards. In one aspect, the card contact surface is formed of a rubber material to provide friction or grip on the cards. It should be recognized that any suitable friction-enhancing feature and/or material may be utilized.

In this embodiment, the card dispenser 400 comprises a linkage mechanism to dispense the cards. For example, the planar sleeve 410, the actuator 420 and the linkage assembly 440 can be configured to form a multi-bar linkage mechanism, such as a four-bar mechanism shown in the figures. Specifically, the actuator can be pivotally coupled to the planar sleeve about actuator pivot 421. The lifter arm 441 can be pivotally coupled to the planar sleeve about lifter pivot 442. A linkage arm 427 can be pivotally coupled to the lifter arm about a pivot 428*a* and pivotally coupled to the actuator about a pivot 428*b*. In one aspect, the lifter pivot 442 can be located remote from the actuator along the bottom of the planar sleeve. The linkage arm 427 can be associated with the actuation end 407 of the actuator and a distal end of the lifter arm 441 such that the lifter arm is coupled to the actuator via a double joint formed by pivots 428*a*, 428*b* and the linkage arm. This configuration can facilitate a compact arrangement of the lifter arm and linkage arm when in the rest position shown in FIG. 7A.

In one aspect, the linkage arm 427 and the actuator 420 can also be configured to slide relative to one another, such as with a channel 429 associated with the pivot 428*b*. These features can facilitate two-stage operation in order to dispense a card. For example, the actuator can be moved from a retaining position (shown in FIG. 7A) through a gap or space between an end of the channel and the pivot in order to release the actuator or, more specifically, the card contact surface 422*a*, from the card. The actuator can therefore move, at least initially, substantially independent of the linkage arm and the lifter arm to release the cards from contact with the actuator prior actuation or movement of the lifter arm to dispense the cards. The actuator can then be further pivoted to cause the lifter arm to force the cards through the opening 413. A lower card contact surface 422*b* of the actuator can be configured to contact the cards as the actuator moves into the dispense position (shown in FIG. 7B) to stabilize the cards when extending from the chamber 412 and prevent unwanted separation of the cards from the card dispenser 400. In one aspect, the lower card contact surface is formed of a rubber material to provide friction or grip on the cards. It should be recognized that any suitable friction-enhancing feature and/or material may be utilized.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A consumer card dispenser, comprising:

a planar sleeve shaped to receive a plurality of consumer cards within a card chamber and having a dispense opening shaped to pass the plurality of consumer cards edgewise, the card chamber being defined at least in part by solid side panels disposed opposite one another and a solid bottom edge opposite the dispense opening;

an actuator extending along an edge of the planar sleeve from the dispense opening to the solid bottom edge and forming a solid sidewall of the card chamber, said actuator pivotable about an actuator pivot fixed relative to the sleeve and located between a retaining end and an actuation end of the actuator such that the actuator pivots from a retaining position to a dispense position, said retaining position orienting a card contact surface of the retaining end against the plurality of consumer cards to prevent removal of the plurality of consumer cards; and a lifter assembly associated with the actuation end and contained entirely within the card chamber adjacent a bottom edge of the card chamber, and adapted to apply force to at least one of the plurality of consumer cards, upon movement of the actuator to the dispense position, sufficient to dispense at least one of the plurality of consumer cards from the dispense opening, wherein the lifter assembly includes an elongate lifter arm that interfaces with the actuator within the card chamber and which rotates about a lifter pivot from a rest position to a lift position.

2. The consumer card dispenser of claim 1, wherein the card contact surface prevents removal of the plurality of consumer cards in the retaining position via a mechanical interference with the plurality of consumer cards.

3. The consumer card dispenser of claim 1, wherein the card contact surface prevents removal of the plurality of consumer cards in the retaining position via a frictional interface with the plurality of consumer cards.

4. The consumer card dispenser of claim 1, wherein the card chamber has a width from 4.5 cm to 6 cm, a depth from 3 mm to 10 mm, and a length from 7.5 cm to 11 cm.

5. The consumer card dispenser of claim 1, wherein the actuator is an elongate member having an angular inner surface which faces the card chamber such that the inner surface only contacts the plurality of consumer cards in the retaining position at the card contact surface.

6. The consumer card dispenser of claim 5, wherein the card contact surface is formed of a rubber, plastic, or metal material.

7. The consumer card dispenser of claim 1, further comprising a biasing member which is operative to move the actuator into the retaining position.

8. The consumer card dispenser of claim 7, wherein the biasing member comprises a spring loaded pin which is in contact with the actuation end of the actuator.

9. The consumer card dispenser of claim 7, wherein the biasing member comprises at least one of a cantilever spring and a torsional spring.

10. The consumer card dispenser of claim 9, wherein outer surfaces of the planar sleeve are free from inward components comprising: the lifter pivot, the lifter arm, the cantilever spring, the torsional spring, and the biasing member.

11. The consumer card dispenser of claim 1, wherein the actuator further includes a finger loop proximate the retaining end opposite the card contact surface.

12. The consumer card dispenser of claim 1, wherein the lifter arm is pivotally associated with the actuator end of the actuator to form the lifter pivot, and the bottom edge of the card chamber includes a fixed surface against which the lifter arm slides to cause pivoting about the lifter pivot.

13. The consumer card dispenser of claim 1, wherein the lifter arm includes at least one staged taper longitudinally oriented along the lifter arm spaced so as to dispense the plurality of consumer cards at multiple distances from the card chamber.

14. The consumer card dispenser of claim 1, wherein the actuator is pivotally coupled to the lifter arm.

15. The consumer card dispenser of claim 14, further comprising a linkage arm pivotally coupled to the actuator and the lifter arm.

16. The consumer card dispenser of claim 15, wherein the actuator is slidable relative to the linkage arm to facilitate release of the plurality of consumer cards prior to movement of the actuator to the dispense position.

17. The consumer card dispenser of claim 1, wherein the actuator and the lifter arm are configured to facilitate release of the plurality of consumer cards prior to movement of the actuator to the dispense position.

18. The consumer card dispenser of claim 1, actuator is configured to be in sliding-rotating contact with the lifter arm to cause motion of the lifter arm.

19. The consumer card dispenser of claim 1, wherein the at least one of the planar sleeve and the actuator are fabricated with a multi-ply construction.

20. The consumer card dispenser of claim 1, further comprising a money clip.

21. The consumer card dispenser of claim 1, wherein the plurality of consumer cards include at least one of credit card, debit card, bank card, drivers license card, discount card, group membership card, medical card and business card.

22. The consumer card dispenser of claim 1, wherein the actuator is only movable relative to the planar sleeve rotationally about the actuator pivot.

23. The consumer card dispenser of claim 1, wherein said lifter arm extends substantially along the bottom edge of the card chamber and is oriented substantially parallel to the bottom edge in the rest position.

24. The consumer card dispenser of claim 1, wherein the lifter pivot is proximate the actuation end of the actuator and fixed relative to the card chamber, and the lifter arm includes an engagement notch which facilitates engagement with the actuation end to rotate the lifter arm about the lifter pivot.

25. The consumer card dispenser of claim 1, wherein the actuator is directly coupled to the sleeve via the actuator pivot.

26. The consumer card dispenser of claim 1, wherein the actuator partially defines the card chamber along the edge of the planar sleeve.

27. The consumer card dispenser of claim 1, wherein pivotal movement of the actuator causes the lifter assembly to apply force to at least one of the plurality of consumer cards sufficient to dispense at least one of the plurality of consumer cards from the dispense opening.

28. The consumer card dispenser of claim 1, wherein the plurality of consumer cards dispense from the dispense opening in a dispense direction, and movement of the actuator non-parallel to the dispense direction causes the lifter assembly to apply force to at least one of the plurality of consumer cards sufficient to dispense at least one of the plurality of consumer cards from the dispense opening.

* * * * *